US008462067B2

(12) United States Patent
Maxwell-Cox

(10) Patent No.: US 8,462,067 B2
(45) Date of Patent: Jun. 11, 2013

(54) APPARATUS FOR AN ANTENNA SYSTEM

(75) Inventor: Graham Maxwell-Cox, Havant (GB)

(73) Assignee: Astrium Limited, Stevenage (GB)

( * ) Notice: Subject to any disclaimer, the term of this patent is extended or adjusted under 35 U.S.C. 154(b) by 592 days.

(21) Appl. No.: 12/557,743

(22) Filed: Sep. 11, 2009

(65) Prior Publication Data

US 2010/0085266 A1 Apr. 8, 2010

Related U.S. Application Data

(63) Continuation-in-part of application No. 12/247,428, filed on Oct. 8, 2008.

(51) Int. Cl.
*H01Q 13/00* (2006.01)

(52) U.S. Cl.
USPC ..... 343/781 P; 343/776; 343/779

(58) Field of Classification Search
USPC ..... 343/776, 779, 772
See application file for complete search history.

(56) References Cited

U.S. PATENT DOCUMENTS

| | | | | |
|---|---|---|---|---|
| 3,521,288 | A | 7/1970 | Schell | |
| 3,953,858 | A * | 4/1976 | Ohm | 343/779 |
| 6,259,414 | B1 * | 7/2001 | Lettington | 343/757 |
| 6,433,752 | B1 * | 8/2002 | Moncada et al. | 343/756 |

FOREIGN PATENT DOCUMENTS

JP 58092104 A 6/1983

OTHER PUBLICATIONS

Mahmoud Shahabadi et al, "Millimeter-Wave Holographic Power Splitting/Combining" IEEE Transactions on Microwave Theory and Techniques, IEEE Service Center, Piscataway, NJ, vol. 45, No. 12, Dec. 1, 1997 XP011037059, ISSN: 0018-9480.

Trappe, N. et al., The Quasi-Optical Analysis of the Hifi Frontend Optical System, 25th Esa Antenna Workshop on Satellite Antenna Technology, Noordwijk, The Netherlands, Sep. 18-20, 2002; [ESA Antenna Workshop on Satellite Antenna Technology], NL Noordwijk : ESA, Sep. 18, 2002, pp. 497-504, XP001128858.

Brune J. et al., "Ein Breitbandiger Oszillator-Messplatz in Flexibler Quasioptischer Technik Fuer Den Frequenzbereich 170 Ghz Bis 260 GHZ. OA Broadband Oscillator Measurement Setup in Flexible Quasi-OpticalTechnique for the Frequency Range 170 GHZ to 260 GHZ" Frequenz, Schiele Lind Schon, Berlin, DE, vol. 49, No. 5/06, May 1, 1995, pp. 105-111, XP000533537, ISSN: 0016-1136.

* cited by examiner

*Primary Examiner* — Hoang V Nguyen
*Assistant Examiner* — Kyana R McCain
(74) *Attorney, Agent, or Firm* — Lando & Anastasi, LLP

(57) ABSTRACT

An apparatus for an antenna system comprising one or more blades for splitting the electromagnetic field received by an antenna into a plurality of sections corresponding to separate beams and redirecting said plurality of sections for detection by a plurality of detectors. The apparatus may comprise a plurality of blades for splitting the field into successively smaller and smaller portions. The plurality of detectors can be positioned outside the focal region of the antenna system. The apparatus may further comprise focusing means for focusing the sections of the field onto another blade or a detector. There is also provided an antenna system comprising a plurality of feed horns for producing a plurality of beams; and a plurality of elements for redirecting said beams towards a focal region of the antenna system so as to form a group of closely packed beams for transmission by the antenna system.

22 Claims, 6 Drawing Sheets

APPARATUS FOR AN ANTENNA SYSTEM

RELATED APPLICATIONS

This application is a continuation-in-part application of U.S. application Ser. No. 12/247,428, entitled "APPARATUS FOR AN ANTENNA SYSTEM," filed on Oct. 8, 2008 which is incorporated by reference in its entirety herein.

FIELD OF THE INVENTION

The invention relates to an apparatus for redirecting the electromagnetic field received in an antenna or beams produced by the antenna.

BACKGROUND OF THE INVENTION

In conventional reflector antenna systems, the narrow patterns in the farfield of the reflector are brought to a focus where a single feed horn or a group of feed horns are placed to capture or sample the reflected energy from the system. To sample the field in different positions, the feed horn or group of feed horns can be moved in the focal plane of the antenna system so as to scan the antenna beams. The beam positions in the far-field move in a nominally linear relation to the feed position shift (for small angles).

SUMMARY

To improve data acquisition time and instrument sensitivity, it is preferred to have a stationary array of feed horns in the focal plane instead of one or more moving feed horns. Unfortunately, the amount of information obtained is limited by the closeness of the beams scanned, which in turn is limited by the dimensions of the feed horn. For telecommunication applications, the dimensions of the feed horns are relatively small (1 to 2 wavelengths in diameter) and closely packed beams can be sampled. However, for radiometry applications, the requirements on the feed to produce Gaussian like beams with low sidelobes from the farfield lead to the use of feed horns that have much larger diameter (6 to 10 wavelengths). When the horns are placed next to each other, the sampled beams are not packed closely enough. For example, in some sub-mm wave applications, it is desired to sample beams spaced apart by 3 mm. However, it is appreciated that the width of the feed horns has to be 10 mm, making it impossible to place the feed horns 3 mm apart. Additionally, each feed horn is provided with signal processing components such as Low Noise Amplifiers (LNAs) and mixers. According to one aspect, it is appreciated that these components may not be small enough to allow the feed horns to be placed closely enough together to sample beams that are packed closely enough.

Aspects of the invention aim to address one or more of these issues.

Aspects of the invention relate generally to an apparatus for splitting the electromagnetic field received in an antenna system into a plurality of sections corresponding to separate beams and redirecting the sections to allow them to be detected away from the focal region of the antenna system.

According to one aspect of the invention, there is provided an apparatus for an antenna system comprising: one or more blades for splitting the electromagnetic field received by an antenna into a plurality of sections corresponding to separate beams and redirecting said plurality of sections for detection by a plurality of detectors.

Each of the one or more blades may redirect a section of the field in a direction based on the region of incidence of that section of the field on the blade. The blade may comprise a first and a second surface and the blade may split the field by redirecting a section of the field incident on the first surface in a first direction and the section of the field incident on the second surface in a second direction, different to the first direction.

The apparatus may comprise a plurality of blades for splitting the electromagnetic field into successively smaller and smaller sections.

Consequently, certain aspects of the invention allow Gaussian beams to be cut or truncated in free space to permit close beams to be separated at spacing smaller than a typical Gaussian horn being used. In one embodiment of the invention the feed horns are permitted to be located away from the focal region. Consequently, feed horns, large enough to produce the required beams, can be used to sample closely packed beams The one or more blades may comprise a prism blade. The one or more blades may additionally, or alternatively, comprise a reflecting blade. The reflective blade may comprise two reflective surfaces joined at an angle.

The one or more blades may comprise at least two blades, one of the blades comprising said two reflective surfaces and said two reflective surfaces being shaped to distort the plurality of sections of the field to allow the other blade of the at least two blades to cut the plurality of sections of the field more efficiently. The two reflective surfaces may be shaped to elongate the cross-section of the beams corresponding to the sections of the field.

The two reflective surfaces may be shaped to focus one of the plurality of sections of the field towards a detector. Alternatively or additionally, the apparatus may comprise at least two blades, one of the blades comprising said two reflective surfaces and said two reflective surfaces being shaped to focus one of the plurality of sections of the field towards the other blade. The two reflective surfaces may comprise cylindrical mirrors.

The apparatus may further comprise a pre-distortion mirror for reflecting the plurality of sections of the field onto the one or more blades, the pre-distortion mirror being configured to elongate the cross-section of the beams corresponding to the plurality of sections of the field to allow closely packed beams to be separated.

The one or more blades may comprise at least two blades, and the apparatus may further comprise focusing means for focusing one of the plurality of sections of the field from one of the blades onto the other blade. Alternatively or additionally, the apparatus may further comprise focusing means for focusing one of the plurality of sections of the field onto a detector. The means for focusing the plurality of sections of the field may be configured to reshape the plurality of sections of the field into circular beams. The means for focusing the redirected plurality of sections of the field may comprise a mirror and/or a lens.

In one embodiment, the one or more blades may comprise a plurality of metallic reflecting blades, the means for focusing may comprise a plurality of metallic reflecting mirrors and the plurality of blades and plurality of mirrors may be cut from a single block of metal. Manufacturing the apparatus as a single unit, or as a few separate units, reduces the number of components required to cut and detect the field and makes the design more mechanically stable.

According to another aspect of the invention, there is also provided a device comprising a plurality of layers, each layer comprising an apparatus according to any one of the claims and an aperture for receiving radiation, the device further comprising means for dividing incoming radiation into a plurality of portions based on at least one parameter of the radiation and redirecting each portions of the plurality of portions of radiation into a separate layer through said apertures.

The at least one parameter may comprise the polarisation of the radiation. The at least one parameter may also comprise the frequency of the radiation.

According to another aspect of the invention, there is also provided an antenna system comprising the apparatus recited above and a plurality of feed horns for receiving the redirected sections of the field.

Additionally, according to another aspect of the invention, there is provided an antenna system comprising: a plurality of feed horns for producing a plurality of beams; and a plurality of elements for redirecting said beams towards a focal region of the antenna system so as to form a group of closely packed beams for transmission by the antenna system.

The plurality of elements may comprise an element arranged to reflect or refract a plurality of incident beams to produce a set of adjacent beams. The antenna system may further comprise a focusing element for focusing the set of adjacent beams onto another element of the plurality of elements.

The plurality of elements may comprise a plurality of reflective blades or prism blades.

BRIEF DESCRIPTION OF THE DRAWINGS

Embodiments of the invention will now be described, by way of example, with reference to the accompanying drawings, in which.

DETAILED DESCRIPTION

Figure 1:
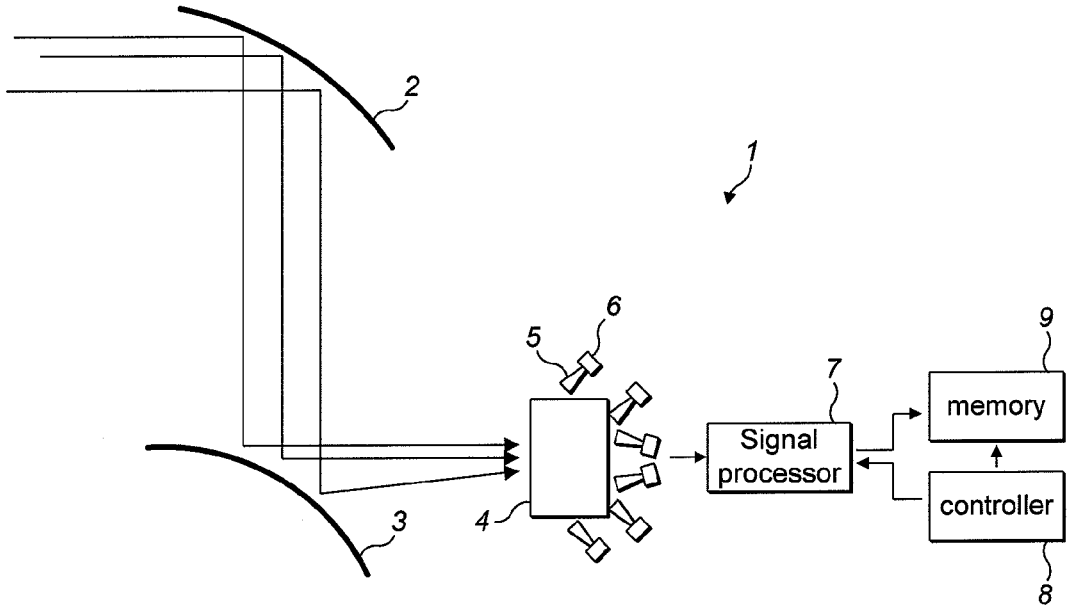
FIG. 1 is a schematic diagram of an antenna system comprising a beam cutter according to one embodiment of the invention.

With reference to FIG. 1, a reflector antenna system comprises a main reflector 2 and a subreflector 3 for receiving and focusing incoming radiation, a beam cutter 4 for splitting the nearfield at the focal region of the system, a plurality of feed horns 5 with associated processing units 6, a signal processor 7, a controller 8 and a memory 9. The reflector antenna system may be used in, for example, radiometry, radio astronomy or Earth remote sensing. In such applications, the incoming radiation is typically sub-mm or microwave radiation. The frequency of the radiation may be, but is not limited to, between 50 GHz and a 3 THz. The reflector antenna system could also be used in a telecommunication system.

The main reflector 2 may be a concave parabolic reflector and the subreflector 3 may be a convex hyperbolic reflector with two foci. Other reflector shapes, to focus the incoming energy, are of course also possible. The main reflector 2 reflects all incoming rays or energy parallel to its axis of symmetry to its focus which is also one of two foci of the subreflector 3. The subreflector 3 subsequently reflects the rays or energy from the main reflector to its second focus, where the beam cutter 4 is located.

The beam cutter 4 is a quasi-optical device that splits the incoming radiation into a plurality of portions and redirects the energy to positions where suitable feed horns 5 are placed to form the required scanned beams. The beam cutter therefore replaces a linear array of horns in the focal region for producing scanned radiation patterns in the farfield of the reflector. It should be noted that, generally, until a feed horn is placed in the focal region of the subreflector, there exist no beams in the farfield of the antenna. Instead, a nearfield exists at the focus, with potential to form beams. The invention uses a beam cutter to sample this field rather than using horns placed there.

The horns 5 have a fairly large diameter in order to produce the required Gaussian like beams with low sidelobes. The diameter may be of the order of 6 to 10 wavelengths, which for a signal of frequency of 250 GHz can mean a diameter of 10 mm. The horns may be corrugated or Potter stepped horns. Each feed horn has an associated processing unit 6 comprising, for example, a low noise amplifier (LNA) that amplifies the signal and a mixer that downconverts the high frequency signal to a lower frequency. The converted signals are fed to a central signal processor 7 for further signal processing. It should be realised that although the central signal processor 7 is shown in FIG. 1 as a single component, it may comprise a plurality of separate components. The controller 8 controls the reception and storage of data in the memory 9. The controller 8 may also control the signal processor 7. The memory 9 may receive data from the signal processor 7 or from a ground station. The reflector antenna system 1 may further comprise a transmit antenna for transmitting the received data to a ground station. Additionally, it may comprise another receive antenna system for receiving instructions from the ground station.

Figure 2:
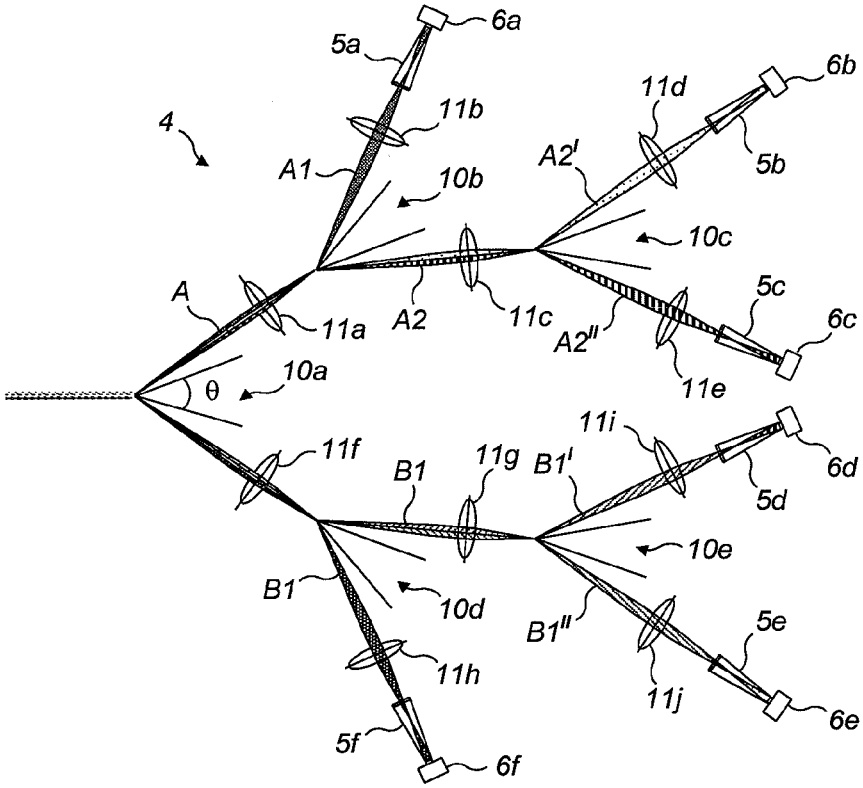
FIG. 2 shows the beam cutter of FIG. 1 in more detail.

One embodiment of the beam cutter 4 according to the invention is shown in more detail in FIG. 2. The beam cutter 4 of FIG. 2 splits the energy in the electromagnetic field received by the antenna into six different beams to be detected by six different feed horns 5*a*-5*f*. The beam cutter has a plurality of field cutting elements for successively cutting the nearfield into smaller and smaller slices. The beam cutter 4 may also have a plurality of separate focusing elements for focusing the energy in the field after the field has been cut. In FIG. 2, the field cutting elements and the focusing elements are assembled in the same plane. All the elements of the beam cutter may be located in a housing. It should be realised that the field cutting elements do not divide the field into two copies of the same information but divide the field into two slices of different information. The field cutting element splits the field based on the point of incidence on the field cutting element. As an analogy, two halves of the same image can be considered.

In FIG. 2, the field cutting elements are provided in the form of reflective blades 10*a*-10*f* and the focusing elements are provided in the form of lenses 11*a*-11*j*. The first reflective blade 10*a* is located in the focal region of the system, where the potential farfield beams are concentrated into a small region. It splits the nearfield into two sections A, B. The first section A is refocused by a first field lens 11*a* and then split by a second blade 10*b* into sections A1 and A2. One of the sections A1 is refocused by a second field lens 11*b* and detected by horn 5*a*. The other section is further split by a blade 10*c* into two sections A2' and A2" which are refocused by respective field lenses 11*d* and 11*e* and detected by respective horns 5*b* and 5*c*. Similarly, the second section of the nearfield B is refocused by field lens 11*f* and split by a fourth blade 10*d* into two sections B1 and B2. One of the sections B1 is refocused and further split by blade 10*e* into two sections B1' and B1" which are refocused by field lenses 11*h* and 11*i* and detected by horns 5*d* and 5*e*. The other sections B2 are refocused by lens 11*j* and detected by horn 5*f* without being divided further.

It should be understood that the angular dependence of the incident field results in the distributed field at the focus of the reflector antenna system. The distributed field is cut by the first blade 10*a*. After the first blade, the reflections and beam corrections change the angular dependence of all the beams, whether they are treated in groups or singularly, and allow further beam division Each blade 10*a* to 10*e* consists of two reflective surfaces, such as two mirrors, joined along an edge facing the radiation. The beams incident on a first of the two reflective surfaces of the blade (e.g. upper surface of blade 10*a* in FIG. 2), are reflected by the first of the two reflective surfaces and thereby redirected in a first direction (towards the upper region of the beam cutter 4 in FIG. 2) and the beams incident on a second of the two reflective surfaces of the blade (e.g. lower surface of blade 10*b* in FIG. 2) are reflected by the second of the two reflective surfaces and thereby redirected in a second direction (towards the lower region of the beam cutter 4 in FIG. 2), which is different from the first direction. The angle between the two reflective surfaces and the orientation of the two reflective surfaces with respect to the incoming radiation determines the directions in which the beams are reflected. The resulting separated beams correspond to different segments of the original field and therefore also different information in the original field. The radiation is focused on, slightly in front of or beyond the edge. The reflective surfaces are provided by a radio frequency conducting material. For example, the blade may be made from metal, including but not limited to aluminium. In more detail, the blade may be made from a bent sheet of metal or a solid block of metal. The surfaces may, for example, be polished, silver-coated or gold-coated. The blades could also be made of plastic, or any other suitable material, and have a reflective coating.

The leading edge of the blade is sharp in order not to produce excessive diffraction and spoil the beams. As an example, the edge may be around a hundredth of a wavelength or approximately 0.01 mm. The angle θ between the two reflecting surfaces of the blade may be between 10 and 45 degrees. However, the exact angle depends on the application. The angle may also be larger than 45 degrees if suitable. In a sub-mm-wave application, the length of each reflecting surface of the blade may be of the order of 20 mm. The blades are angled such that the reflected or refracted energy is directed conveniently to the next blade or focusing element. The blades do not necessarily have to cut the field in two equal portions. For example, blades 10*b* and 10*d* may cut the field such that slices A1 and B2 contain the same proportion of the original field as slices A2', A2", B1' and B1".

The lenses may be made of plastic, for example polytetrafluoroethylene (PTFE). Alternatively, the lenses may be made out of glass. In one embodiment, the lenses may have a hyperbolic shape with concentric grooves to improve the efficiency with which the field is let through the lens. The lenses refocus the energy to a region about the tip of the next blade or the focal region of a feed horn. The focal region of a feed horn generally lies inside the horn, slightly beyond the aperture of the feed horn. It should be understood that it is not always necessary to refocus the field before cutting it again or before it is detected by a feed horn. Whether a lens is placed between two blades or between a blade and a feed horn depends on the specific design of the beam cutter.

Due to beam efficiency considerations, the feed horns 5*a* to 5*f* would typically be chosen to be cylindrical horns to produce circular beams. However, it should be noted that it is also possible to have elliptical aperture corrugated horns or rectangular horns that produce elliptical beams. The cutting of the field changes the shape of the beams into a more elliptical shape. The electromagnetic field comprises components that are extended in angle and, when the field is cut, there is some loss of the higher angular components that are blocked by the presence of the blade. The resulting shape is therefore elliptical. The quality of the pattern in the farfield formed for the very closest beams therefore degrades with proximity to the blade. Some of these beams therefore need reshaping to match better the cylindrical horns. By using suitable shaped lenses, such as anamorphic lenses, the beams can be reshaped and the quality improved.

Figure 3:
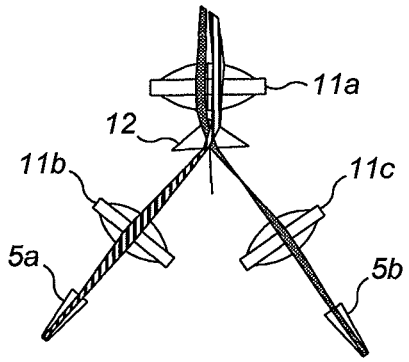
FIG. 3 illustrates a variant of an element of the beam cutter.

With reference to FIG. 3, an alternative to the reflective blades in FIG. 2 for the field cutting elements are shown. In this case, the field cutting element is created using a prism blade 12. When using a prism, the separation of the beams is carried out by refraction rather than by reflection. The energy is focused by a lens 11*a* onto the prism blade 12 and refracted into two beams. The beams incident on a first surface of the prism is refracted in a first direction and the beams incident on a second surface of the prism is refracted in a second direction. As shown in FIG. 3, the beams cross over in the prism. Each of the two beams is refocused by a respective lens 11*b*, 11*c* into respective horns 5*a*, 5*b*. Internal reflection may occur in the prism and a metal foil (not shown) may be included down the centre line of the prism to provide isolation between the beams. Again, the angle of the surfaces of the prism facing the incident radiation may be between 10 and 45 degrees. However, the exact angle depends on the application. The angle may also be larger than 45 degrees if suitable.

Figure 4:
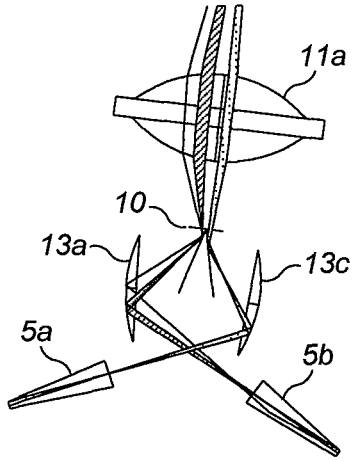
FIG. 4 illustrates a variant of another element of the beam cutter.

With reference to FIG. 4, an alternative to the lenses in FIG. 2 for the focusing elements is shown. In this embodiment, the focusing elements are provided by mirrors 13 instead of field lenses. The energy is focused by a lens 11*a* onto a blade 10 and refracted into two beams. Each beam is then reflected by a respective mirror 13*a*, 13*b* towards a horn 5*a*, 5*b*. As shown, when using mirrors, the beams cross over when feeding into the horns. The mirrors may be made from, but is not limited to, metal, such as polished aluminium.

In some embodiments of the beam cutter, the field cutting element and the focusing element may be combined as a single element. Instead of the field cutting element being formed from two plain mirrors joined along an edge, the two mirrors may be shaped mirrors. The curvature of the mirrors along the joining edge may be small so as to keep a roughly uniform thickness along the edge and thereby reduce diffraction at the joining edge. The field cutting element would refocus the split field and control the beam waists of the resulting beams. Consequently, the field cutting element would both split the field and refocus the energy. The shaped mirrors may for example be cylindrical mirrors joined along a sharp edge along a line parallel to the cylinder axis of each of the mirrors. Such a blade would refocus the beam in one plane. The shaped mirrors may also have a shape corresponding to any other conic section, such as an elliptical or hyperbolic shape, or an arbitrary shape chosen for optimising the pattern.

Figure 5:
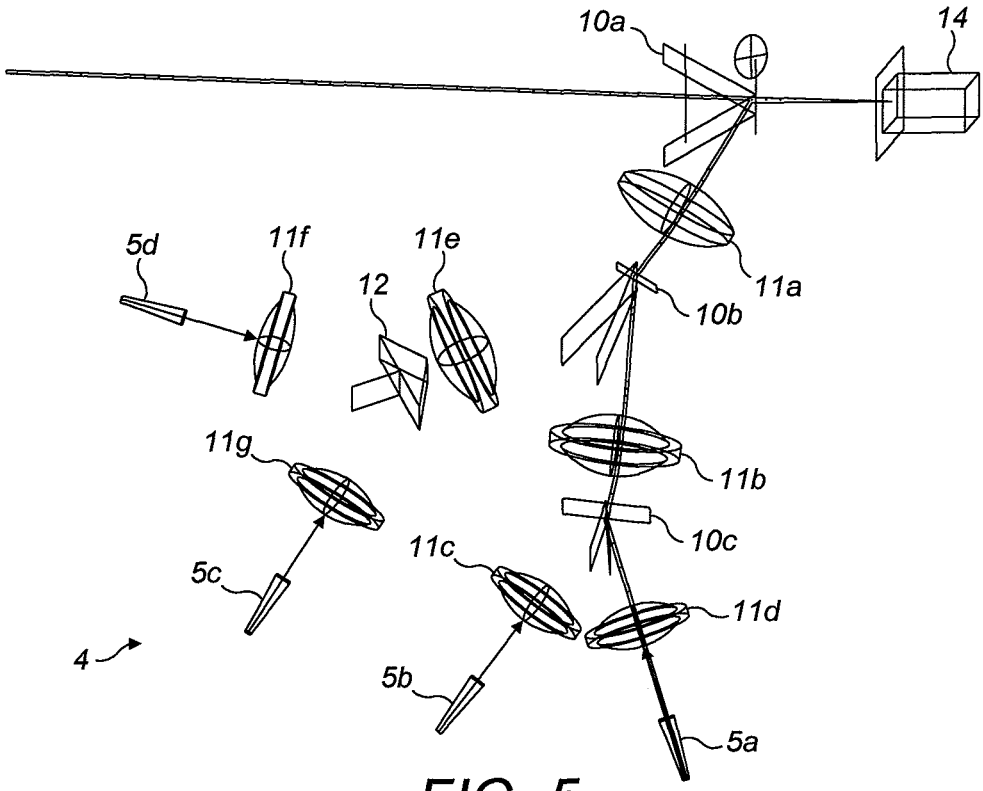
FIG. 5 shows part of a beam cutter according to another embodiment of the invention.

It should be realised that a combination of reflective blades 10, prisms 12, lenses 11 and mirrors 13 may be used to form the beam cutter 4. In FIG. 5, one half of a beam cutter 4 that produces 8 slices of the nearfield is shown. The beam cutter comprises both a prism blade 12 and a reflective blade 10 for cutting the field. The path of a single ray through the beam cutter 4 is shown. The incoming energy is reflected by a mirror 14 onto a first reflective blade 10*a* that carries out the first level division of the field. The second level division is performed with another reflective blade 10*b*, creating two groups of two beams. The first pair of beams is subdivided with a further reflective blade 10*c* while the remaining beams are divided with a prism blade 12. The resulting beams are refocused to be received by feed horns 5*a* to 5*d*. Between each of the divisions the fields are refocused to next blade or horn by means of simple field lenses 11*a*-11*g*. It should be understood that mirrors may be used instead of the lenses.

Figure 6:
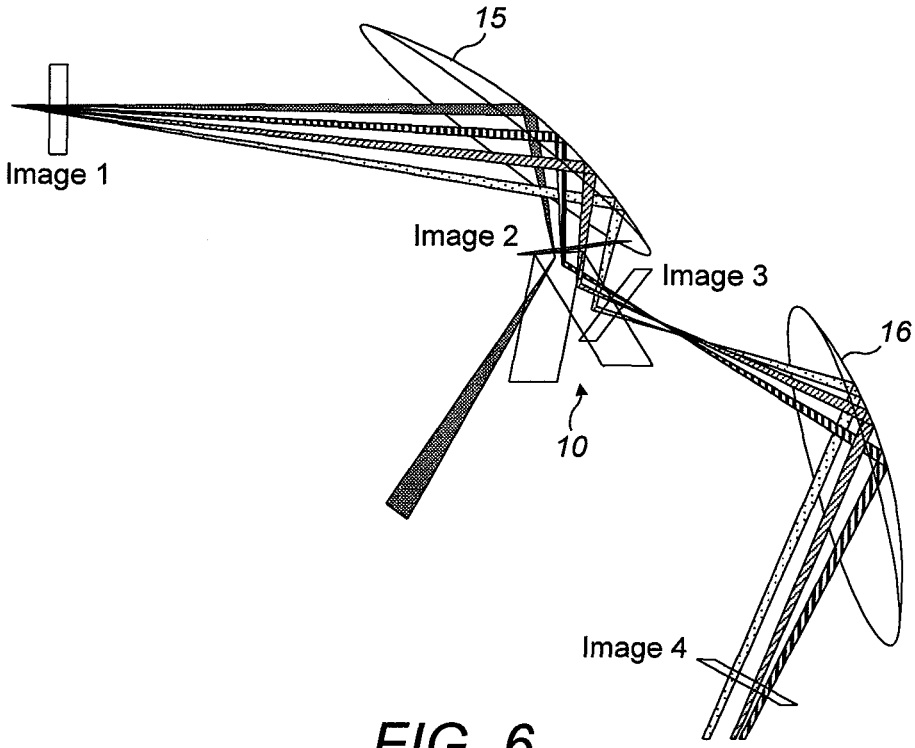
FIG. 6 illustrates part of a beam cutter according to yet another embodiment of the invention.

In some embodiments of the invention, a pre-distortion is introduced in the shape of the beams corresponding to the sections of the field prior to dividing the field in order to improve the separation of the beams. The beam distortion may be provided by an offset mirror 15 placed prior to the field cutting element 12 in the field path as shown in FIG. 6. The offset pre-distortion mirror 15 is designed to elongate the field in a plane parallel to the blade edge, allowing the blade to approach the beam more closely without undue scattering, and to divide beams that a close together. For some incidence angles at the pre-distortion mirror, the cross-sections of the portions of the field corresponding to the beams are elongated into a shape resembling a flattened ellipse with the major axis parallel to the edge of the blade facing the radiation. The offset pre-distortion mirror 15 may be an offset conic section mirror. For example, the mirror may have the shape of part of an ellipsoid or a sphere.

As further shown in FIG. 6, a correction mirror 16 with corresponding offset parameters to the pre-distortion mirror 15 may be provided to reflect the cut field. The second mirror 16 corrects the distortion introduced by the first mirror 15. It may also focus the reflected beam. For example, the correction mirror 16 may return the cross-section of the beam to a desired circular shape for matching a horn. The degree of beam distortion introduced by the pre-distortion mirror depends on the incident angle of the field and therefore varies from one beam angle to another.

With further reference to FIG. 6, the distortion mirror 15 is positioned to allow the field to approach the mirror at a high incidence angle (away from the normal to the surface). As a result, the beam behaviour in the secondary focal region of the mirror will be of a caustic nature with a sharp delineation of the field towards the surface of the reflector. The level of distortion of the beam depends on the angle of reflection at the mirror surface. The larger the incidence angle, away from the normal to the surface, the greater the distortion of the beam. If the incident beam on the pre-distortion mirror is oblique to the mirror surface, the beam is more distorted than a field incident at an angle normal to the mirror surface. In other words, if the incident beam approaches the mirror away from the first focus of the mirror, the distortion is greater.

As the beam advances away from the mirror the beam cross-section becomes elongated in a plane orthogonal to the incident field and parallel to the edge of the blade 10 of the field cutting element. The blade 10 may be placed at the position where the field is elongated into a line (a caustic) in order to take advantage of the common geometry of the field and the blade (both lines) and divide the field efficiently. The distortion of the beam shape allows the field to be cut with less energy passing to the backside of the blade, improving the cutting efficiency. In addition, the caustic region between the pre-distortion mirror 15 and the following blade 10 and reflector, reduces the field for the beam on the trailing edges of the blade 10, so reducing diffraction effects between these two edges of the blade 10. FIG. 6 shows a reflecting blade 10 but the field cutting edge could also be a prism blade 12.

As shown in FIG. 6, one of the beams is separated from the other beams by the field cutting element 10 whereas the other beams are reflected off the blade towards the correction mirror 16, crossing each other on the way. The correction mirror corrects the cross-section into a circular cross-section. The beams can then be further reflected or redirected to horns or separated further by further field cutting elements 10, 12 (not shown). The beam that is separated at the blade 10 shown in FIG. 6 would have to be corrected by another correction mirror (not shown) to provide a better match to a feed horn.

Figure 8:
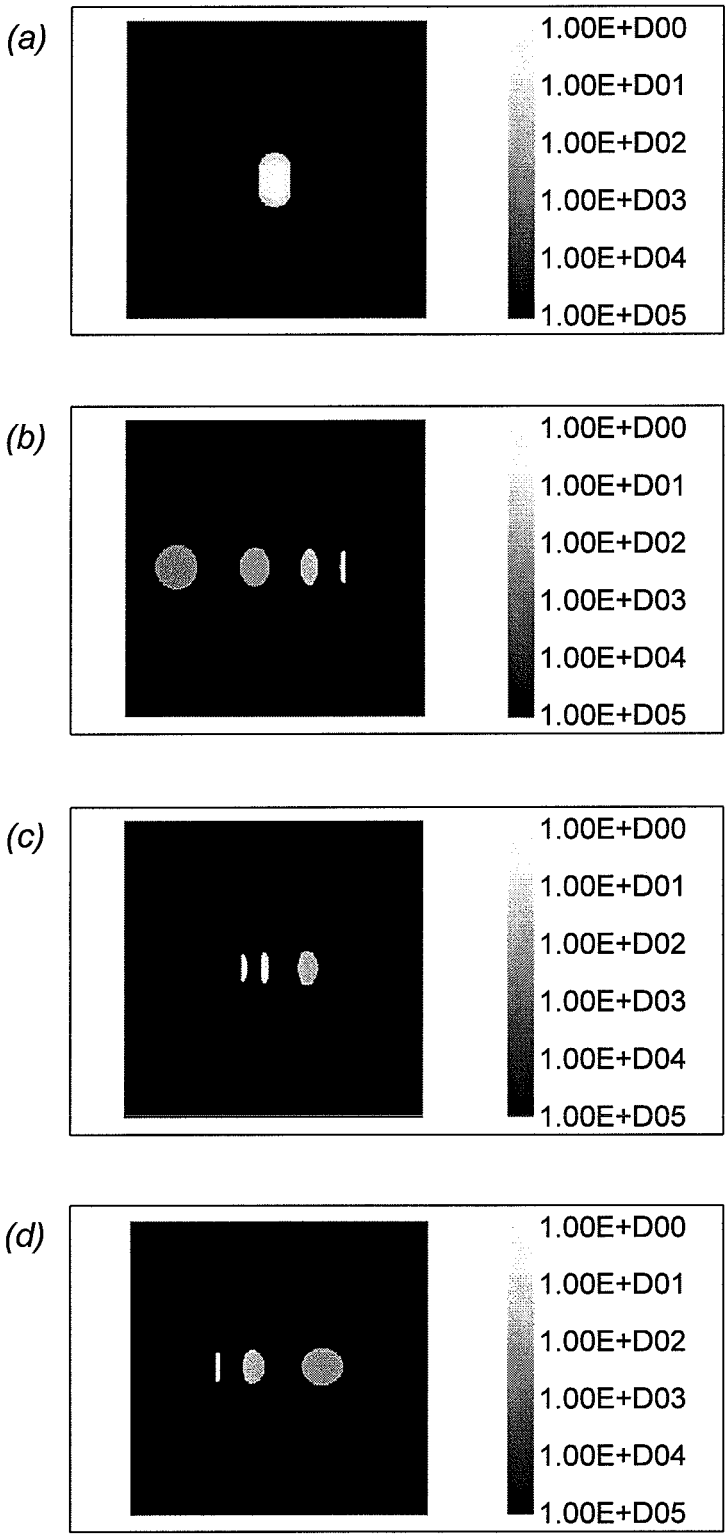
FIGS. 8(*a*) to 8(*d*) show the shape of the beams passing through the beam cutter of FIG. 6.

The shape of the beams in images 1 to 4, shown in FIG. 6, will be described in more detail below with reference to FIGS. 8(*a*) to 8(*d*).

In some embodiments, the correction mirror 16 may be combined with the mirrors 13, described with respect to FIG. 4, for focusing the field portions. An offset ellipsoidal mirror, positioned such that beams are incident at a high angle, can both correct the beam for any distortion and refocus the beam into a suitable shape for feeding a horn. Moreover, in some embodiments, a lens (not shown) may be used to put the incident beams at the first focus of the first offset mirror.

Figure 7:
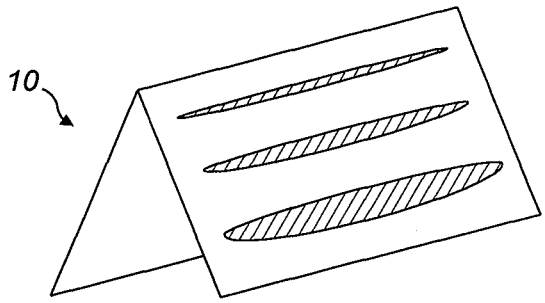
FIG. 7 schematically illustrates how the field is incident on an element of the beam cutter of FIG. 6.

FIG. 7 schematically shows how the distorted beams are incident on the blade. The cross-sections of the beams are in the shape of flattened ellipses on one side of the beam. The cross-sections of the beams are elongated in a direction parallel to the leading edge of the blade 10. Since the level of distortion of the beam depends on the angle of reflection off the mirror surface and the closer the incident beam to the mirror surface the greater the distortion, beams that are further from the front of the blade edge are less flattened than the beams near the front of the blade edge. The distortion of the beams is exaggerated to some extent in FIG. 7. Beams with low angles of incidence may be less distorted than the beams shown in FIG. 7.

FIGS. 8*a* to 8*d* show the result of a simulation of the effect of the pre-distortion and correction mirrors in the beam cutter of FIG. 6. The Figures show the beam intensity (coherent irradiance) in watt per square meter ($W \cdot m^{-2}$) in areas of size 10 mm×10 mm at four different stages in the beam path. The beam intensity range corresponds to a range of 0 to −50 dB. As seen in FIG. 8(*a*), the field starts out as four closely packed beams (Image 1 in FIG. 6). FIG. 8(*b*) shows the shape of the beams just before the four beams are reflected off the field cutting element 10 (Image 2 in FIG. 6) and FIG. 8(*c*) shows the shape of the beams just after the three remaining beams have been reflected by the cutting element towards the correction mirror (Image 3 in FIG. 6). Just before and after the cutting element 10, the beams can be seen to have been separated and some of the beams have been distorted into a vertical shape. The shape depends on the angle of incidence on the pre-distortion mirror 15 and the position of the image in the field path. FIG. 8(*d*) shows the shape of the beams after the field has been corrected (Image 4 in FIG. 6). As shown, after the correction, the beam nearest the axis is now near circular. The other beams will become circular at slightly different positions along the axis It should be realised that in the beam cutter wherein distortion is introduced to more efficiently cut the field, a correction mirror is not required after each field cutting element 10. If the orientation of the field relative to the blade is satisfactory (sufficiently parallel), the field can be cut again without correction. When a particular beam has been separated, a correction mirror can be used before the feed horn to correct the beam towards a circular profile for matching the feed horn.

Figure 9:
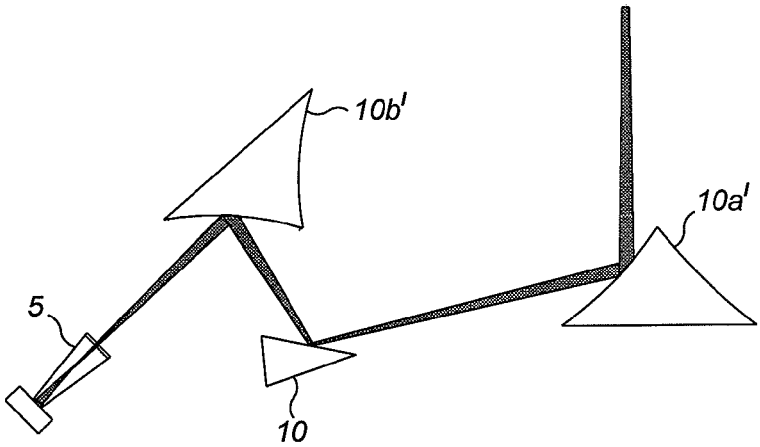
FIG. 9 illustrates further variants of the elements of the beam cutter.

With reference to FIG. 9, in some embodiments, the pre-distortion effect, the correction effect and the focusing effect are all provided by the blades themselves. FIG. 9 shows a single beam being reflected between three blades, 10*a*', 10*b*' and 10, towards a horn 5. The first blade 10*a*' and the last blade 10*b*' have curved faces. In one embodiment, the curvature corresponds to the curvature of a sphere but other shapes are also possible. The second blade is a planar blade. The curved faces of the first blade 10*a*' are designed to distort the beam and the curved surfaces of the last blade 10*b*' are designed to provide a corresponding correction to the beam and to focus the beam into a round beam. The planar second blade 10 is provided to intercept the field between the two curved mirrors and cut the field again.

As shown in FIG. 9, a beam is incident and reflected by the first blade 10*a*'. The first blade further focuses and distorts the beam to allow the beam to be separated more easily at the next blade. In other words, the cutting and the pre-distortion for the next blade are performed in one go by the first blade. The beam is then reflected from the side of the planar second blade 10, corrected and refocused by the curved last blade 10*b*' and fed into the horn 5. The planar blade 10 only acts as a reflector for the beam shown in FIG. 9. Consequently, for a particular application and incoming field, the planar blade 10 can be replaced with a mirror. However, depending on the angular orientation of the planar blade 10 and on where the field is incident on the first curved blade, the planar blade can also be used as a beam cutting element. Similarly, the last curved blade 10*b*' also acts as a reflector for the beam shown in FIG. 9 but, by changing its angular orientation, the curved blade 10*b*' can be used to cut the beam further. By using curved blades, diffraction between the different beams is minimised and the field is cut more efficiently. Beams further from the axis of the curved blade are not distorted as much as beams closer to the axis and they can be cut by the same technique again, i.e. another curved blade. Consequently, in some embodiments, the planar blade may be replaced by a third curved blade or, as mentioned above, the angular orientation of the last curved blade can be modified to cut the field further. It should be realised that the curved blades may have different curvature on each side to compensate for differences in the shapes of the beams incident on different positions on the blade.

The processing units 6, comprising for example amplifiers and mixers, are not shown in FIGS. 3, 4, 5, 6 and 9 for the sake of clarity. However, it should be realised that each feed horn can be connected to various signal processing components. Moreover, it should be realised that the lines and planes shown near the blades in FIGS. 3 to 6, perpendicular to the incident radiation for the reflective blades and parallel to the incident radiation for the refractive blades, are schematic field lines and not part of the blades.

Figure 10:
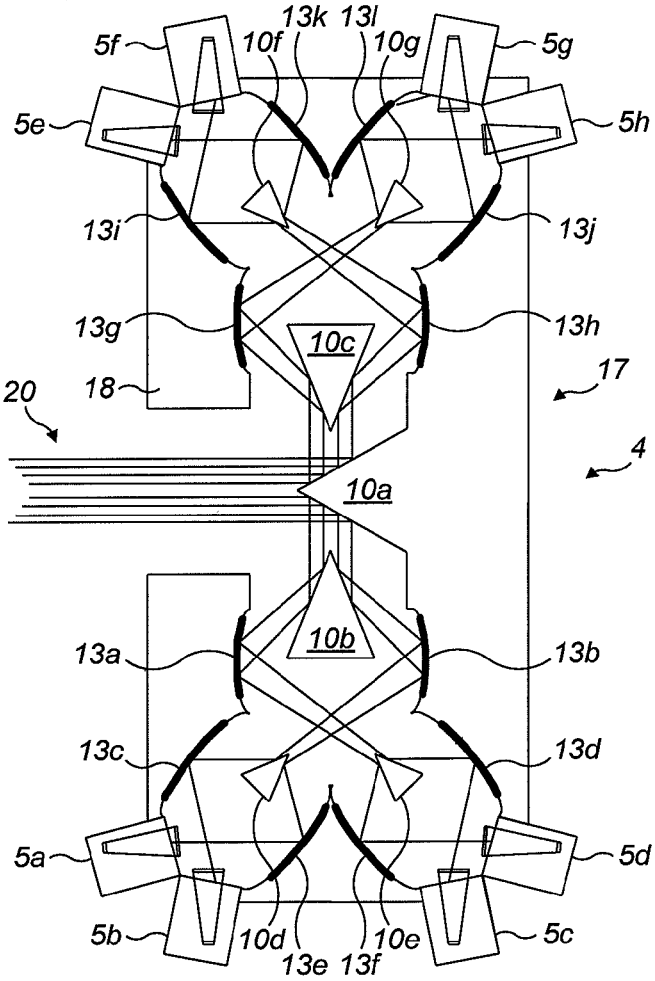
FIG. 10 shows a beam cutter provided as a single unit of metal.
Figure 11:
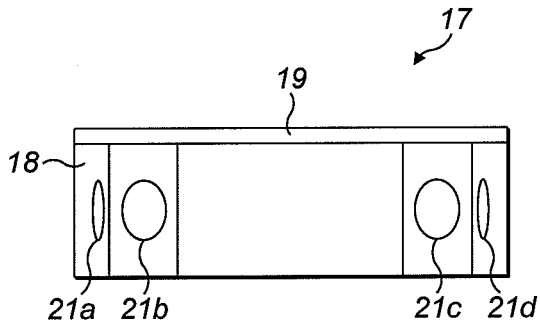
FIG. 11 shows a side view of the beam cutter of FIG. 9.

FIGS. 10 and 11 illustrate an embodiment of the beam cutter 4 comprising field cutting elements 10, 12 provided by metallic blades and focusing elements provided by offset metallic mirrors. By selecting metallic blades and mirrors, the beam cutter, or at least most of the components of the beam cutter, can be made entirely out of metal. In the embodiment of FIGS. 10 and 11, the beam cutter 4 is provided as a single unit 17 shaped from a single machined block of metal 18 and fitted with a lid 19. As an alternative, the beam cutter 4 may be constructed from a plurality of components forming an assembly as if cut from a single block of metal. The unit may have slots for receiving any separate components such as, for example, any required plastic lenses or anamorphic mirrors manufactured separately. The blades may be planar or curved blades. The design is compact, has its components in a single plane, and provides plenty of room for the feed horns and their associated detector components, for example, the mixer blocks and Low Noise Amplifiers 6.

As shown in FIG. 10, the radiation is received through an aperture 20 in the block to a focus in a region 3 to 5 mm inside the block. A first level blade 10*a* is provided in the focus region to split the radiation into two sections. A pair of second level blades 10*b*, 10*c* is provided to cut each of the two sections into two slices to form two sets of two slices. No separate mirrors are used between the first level and the second level blades in this embodiment. The reflective surfaces of the first level blade may be plain mirrors or they may be cylindrical or spherical mirrors that also refocus the energy towards the second blade. The walls of the inside of the block are machine shaped and polished to act as mirrors for reflecting and refocusing the field towards another blade or a feed horn. The walls may also be silver or gold plated. The two sets of two slices are reflected onto third level blades 10*d*-10*g* that split the radiation into eight slices, which in turn are detected by horns.

As mentioned above, one or more of the blades 10*e* to 10*g* of FIG. 10 may further have curved surfaces for introducing a distortion or providing a corresponding correction, as described with reference to FIG. 9, in order to allow more closely packed beams to be separated. Alternatively, or additionally, although not shown in FIG. 10, the single unit 17 could also be designed to include a pre-distortion mirror 15 and/or a correction mirror 16 as described with respect to FIG. 6 to further improve the cutting efficiency.

FIG. 11 shows the beam cutter block 17 from the side without the feed horns. Holes 21*a*-21*d* for receiving the feed horns 5*a*-5*d* of FIG. 10 are located along the side of the beam cutter. As an example, for an application with radiation of 300 GHz, the height of the block including the lid may be approximately 20 mm.

Figure 12:
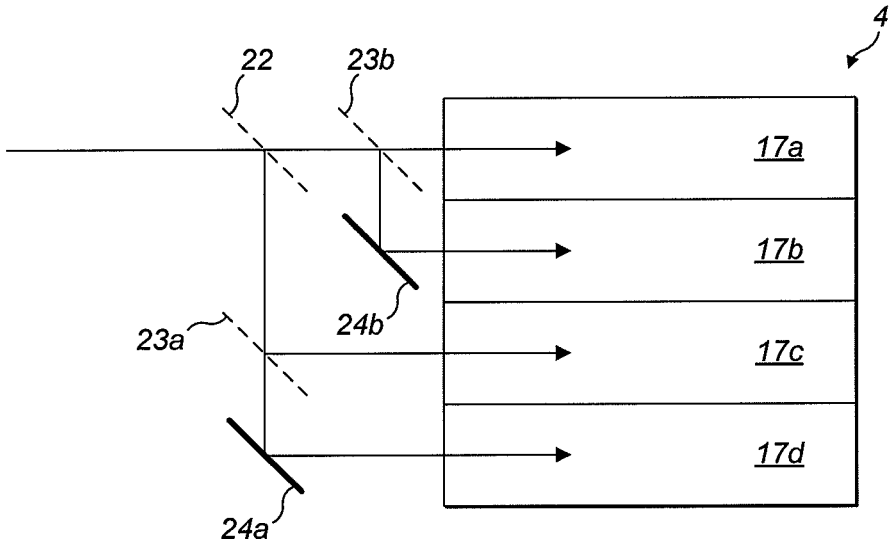
FIG. 12 illustrates how the beam cutters can be stacked.

Two or more of the blocks 17 described with reference to FIGS. 10 and 11 can be stacked to provide dual linear polarisation and extra bands of operations. A schematic diagram of a four block beam cutter unit is shown in FIG. 12. In the focus region of the antenna system a polarising plate 22 is provided for separating the nearfield into two different polarisations. Each portion of the nearfield energy is then split by, for example, a frequency selective surface (FSS) or a dichroic filter 23*a*, 23*b* into two different frequencies providing two groups of two field portions. The resultant field portions are then focused, using mirrors 24*a*, 24*b* if necessary, onto the first blade of each block, 17*a*-17*d*, and then divided and redirected to the feed horns (not shown in FIG. 12). If each block produces 8 beams, the unit would produce a staring array of 8 beams with co-registered beams in frequency and polarisation. Of course, additional frequency selective surfaces can be provided to divide the field into smaller frequency bins. It should be realised that divisions based on polarisation and frequency are only examples and divisions based on other characteristics of the radiation can also be considered.

Although FIGS. 10, 11 and 12 show the component of each beam cutter block in a single plane, it should be understood that the components for each beam cutter block could be mounted in different planes into a compact 3D space if required by the application.

It should also be realised that the blades and focusing elements could also be used in a transmit antenna to produce a collection of closely packed beams for transmission by the antenna. The beam cutter 4 would then provide a beam combiner instead. In a transmit antenna, the feed horns produce different beams that are transmitted towards the cutting elements. Each of the cutting elements 10, 12 reflects or refracts a plurality of incident beams to produce a set of closely packed adjacent beams. The focusing elements 11, 13 refocus and reshape the set of closely packed beams. The cutting elements closest to the feed horns reflects or refracts two beams into a set of two adjacent beams, whereas the cutting elements further away from the feed horns reflects two sets of adjacent beams, or one set of adjacent beams and a single beam, into a new set of adjacent beams. The cutting elements are arranged such that at least two beams are incident on a cutting element from different directions but reflected, or refracted, in substantially the same direction. The cutting elements may be designed with curved surfaces, as described with reference to FIGS. 6 to 9, for distorting and correcting the beams in order to create more closely spaced beams. Alternatively or additionally, a distortion mirror 15 and correction mirror 16 may be included to improve further the efficiency by which the beams are combined. A beam combiner could, for example, be used in radar or telecommunication transmit systems in which closely packed beams are required. In the transmit system, the feed horns would be located outside the focal region but the blades, mirrors and lenses would redirect the beams from the feed horns to the focal region for transmission by the antenna system, thereby making it possible to produce more closely packed beams than if the feed horns had been located in the focal region. Depending on the arrangement of reflectors in the transmit antenna, the focal region would correspond to a focus of a single reflector or a focus of a subreflector.

The transmit antenna could have the same arrangement of components as described with respect to FIGS. 1 to 12 for a receive antenna but the direction of radiation would of course be the opposite to that described with respect to the Figures above. For example, with reference to FIG. 2, the beams would be produced by feed horns 6*a* to 6*f*, focused by a lenses 11*b*, 11*d*, 11*e*, 11*h*, 11*i* and 11*j* and successively combined by blades 10*a* to 10*j* to form a set of closely packed beams. Then, with reference to FIG. 1, the set of beams would be reflected by the sub reflector 3 towards the main reflector 2 and away from the antenna system 1.

Whilst specific examples of the invention have been described, the scope of the invention is defined by the appended claims and not limited to the examples. The invention could therefore be implemented in other ways, as would be appreciated by those skilled in the art.

For example, even though some components of the beam cutter have been labelled as mirrors and other components have been labelled as blades, it should be understood that blades can be used to both reflect and cut the field. The mirrors can therefore be replaced by blades and the blades that only provide a reflecting function can be replaced by mirrors. Moreover, the number of blades used in the beam cutter depends on the application. In some embodiments, a single blade is used while in other embodiments a plurality of blades is used.

Moreover, even though the beam cutter has been described to cut the nearfield of the antenna system, it should be understood that the electromagnetic field cut by the beam cutter is not limited to the nearfield of an antenna. The beam cutter could be used to cut any electromagnetic field. It could be possible for the electromagnetic field to be in the far-field of some component in the system and the beam cutter could then be used to split the farfield of that component. Moreover, although the antenna system of FIG. 1 has been described to have a particular configuration of main and sub reflectors for receiving the incoming radiation or transmitting the outgoing radiation, the antenna system can have any suitable reflector arrangement.

The invention claimed is:

1. Apparatus for an antenna system comprising:

one or more blades to split the electromagnetic field received by an antenna into a plurality of sections corresponding to separate beams and redirect said plurality of sections for detection by a plurality of detectors, wherein at least one of the one or more blades comprises a first and a second surface intersecting at an edge and wherein the edge of at least one blade is arranged to split the field incident on the blade by redirecting at least a first section of the field incident on the first surface in a first direction and at least a second section of the field incident on the second surface in a second direction, different to the first direction.

2. Apparatus according to claim 1, wherein each of the one or more blades is configured to redirect a section of the field in a direction based on the point of incidence on that blade.

3. Apparatus according to claim 1, wherein each of the one or more blades comprises a first and a second surface and the blade is configured to split the field by redirecting a section of the field incident on the first surface in a first direction and the section of the field incident on the second surface in a second direction, different to the first direction.

4. Apparatus according to claim 1, comprising a plurality of blades to split the field into successively smaller and smaller sections.

5. Apparatus according to claim 1 wherein at least one of the one or more blades comprises a prism blade.

6. Apparatus according to claim 1, wherein at least one of the one or more blades comprises a reflecting blade.

7. Apparatus according to claim 6, wherein the reflective blade comprises two reflective surfaces joined at an angle.

8. Apparatus according to claim 7, comprising at least two blades, a first of the at least two blades comprising said two reflective surfaces and one of said two reflective surfaces being arranged to redirect a plurality of sections of the field incident on the surface to a second of the at least two blades and shaped to distort the plurality of sections of the field to facilitate cutting of the plurality of sections of the field by the other blade of the at least two blades.

9. Apparatus according to claim 8, wherein the two reflective surfaces are shaped to elongate the cross-section of the beams corresponding to the sections of the field incident on said two reflective surfaces.

10. Apparatus according to claim 7, wherein each of the two reflective surfaces are shaped to focus a section of the plurality of sections of the field towards a respective detector.

11. Apparatus according to claim 7, comprising two blades, one of the blades comprising said two reflective surfaces and one of said two reflective surfaces being shaped to focus one of the plurality of sections of the field towards the other blade of the two blades.

12. Apparatus according to claim 1, further comprising a pre-distortion mirror to reflect the plurality of sections of the field onto the one or more blades, the pre-distortion mirror being configured to elongate the cross-section of the beams corresponding to the plurality of sections of the field to allow closely packed beams to be separated.

13. Apparatus according to claim 1, further comprising at least one focusing element to focus at least one of said plurality of sections of the field onto a detector or a blade.

14. Apparatus of claim 13, wherein the at least one focusing element is configured to reshape the plurality of sections of the field into circular beams.

15. Apparatus according to claim 13, wherein the at least one focusing element comprises at least one out of a mirror and a lens.

16. Apparatus according to claim 13, wherein the one or more blades comprise a plurality of metallic reflecting blades and at least one focusing element comprises a plurality of metallic mirrors and wherein the plurality of metallic reflecting blades and mirrors are cut from a single block of metal.

17. A device comprising a plurality of layers, each layer comprising an apparatus according to claim 1 and an aperture for receiving radiation, the device further comprising a splitter to divide incoming radiation based on at least one parameter of the radiation and to redirect the divided radiation into separate layers through said apertures.

18. A device according to claim 17, wherein the splitter is configured to divide the radiation based on the polarisation of the radiation or the frequency of the radiation.

19. An antenna system comprising the apparatus according to claim 1 and a plurality of feed horns for receiving the redirected and refocused sections of the field.

20. An antenna system comprising:

a plurality of feed horns to produce a plurality of beams; and a plurality of elements to redirect said beams towards a focal region of the antenna system so as to form a group of closely packed beams for transmission by the antenna system, the plurality of elements comprising an element having a first surface for redirecting at least one of said beams received from a first direction and a second surface for redirecting at least another of said beams received from a second direction, wherein the first and second surfaces intersect at an edge.

21. An antenna system according to claim 20, wherein the plurality of elements comprises an element arranged to reflect or refract a plurality of incident beams to produce a set of adjacent beams and the antenna system further comprises a focusing element to focus the set of adjacent beams onto another element of the plurality of elements.

22. An antenna system according to claim 20, wherein the plurality of elements comprises a plurality of reflective blades or prism blades.

* * * * *